US005142773A

United States Patent [19]

Yunoki

[11] Patent Number: 5,142,773

[45] Date of Patent: Sep. 1, 1992

[54] SLIDER HOLDING APPARATUS

[75] Inventor: Akio Yunoki, Namerikawa, Japan

[73] Assignee: Yoshida Kogyo K.K., Tokyo, Japan

[21] Appl. No.: 747,961

[22] Filed: Aug. 21, 1991

[30] Foreign Application Priority Data

Aug. 29, 1990 [JP] Japan ..... 2-89535[U]

[51] Int. Cl.[5] ..... A41H 37/06

[52] U.S. Cl. ..... 29/768; 29/408

[58] Field of Search ..... 29/766, 768, 408, 409, 29/33.2

[56] References Cited

U.S. PATENT DOCUMENTS 3,874,057 4/1975 Kawakami et al. .

4,049,155 9/1977 Kawakami et al. ..... 29/768

4,771,522 9/1988 Osaki ..... 29/33.2

4,782,587 11/1988 Yunoki ..... 29/768

4,974,315 12/1990 Yunoki ..... 29/768

*Primary Examiner*—P. W. Echols

*Attorney, Agent, or Firm*—Hill, Van Santen, Steadman & Simpson

[57] ABSTRACT

An apparatus is intended for holding a slider during threading through the slider a continuous slide fastener chain having a succession of fabric pieces along each of the opposite longitudinal marginal edges. The apparatus includes a slider holder adapted to releasably hold a slider receive a slider and an uppermost position where the fabric-pieced slide fastener chain is threaded through the slider. The apparatus additionally includes a slider holder retainer disposed on the path of vertical movement of the slider holder and adapted for retaining the slider holder stably, as the slider holder assumes the uppermost position for the threading operation, so as to prevent the slider holder from being wobbled and pulled downstream by the fabric-pieced slide fastener chain during the threading thereof through the slider.

3 Claims, 3 Drawing Sheets

SLIDER HOLDING APPARATUS

BACKGROUND OF THE INVENTION

1. Field of the Invention

The present invention relates generally to an apparatus for holding a slider during the threading of a slide fastener chain through the slider in the manufacture of a slide fastener and particularly to a slider holding apparatus especially adapted for threading through a slider of a slide fastener chain having a succession of fabric pieces attached to each of the opposed longitudinal marginal edges thereof.

2. Description of the Prior Art

A conventional slider holding apparatus of the type described includes a holder body that is vertically movable and has, at its upper end, a first slider seat half. A supporting arm is pivotally mounted on the holder body, and is angularly movable between an inclined position and an upright position. Another (or "second") slider seat half is mounted at the upper end of the holder body, and coacts with the first slider seat half to provide a slider seat upon which the slider resets. A locking lever is also pivotally mounted on the holder body, and has a locking projection at its upper end. The locking lever is normally urged by a spring to cause a projection to engage with an aperture of a pull tab of the slider resting on the slider seat. Once the slider is thus firmly held on the slider seat, the slider holding apparatus is moved upwardly until the slider held on the slider seat comes into registry with a feeding path of a continuous slide fastener chain. Eventually, the continuous slide fastener chain is threaded through the slider. A typical slider holding apparatus of this type is disclosed in Japanese Patent Laid-open Publication No. 63-5704.

This known apparatus is very satisfactory when used for threading a slide fastener chain proper through a slider, that is, a slide fastener chain with no fabric pieces attached to its opposed longitudinal edges. However, known apparatus are unsuitable for threading a slide fastener chain with a succession of fabric pieces already attached to each of the opposed longitudinal edges thereof. The fabric pieces are usually heavy and hang downward from the slide fastener chain on its opposite sides. Forcing the slide fastener chain with such heavy fabric pieces through the slider causes the holding apparatus to wobble, and makes the slider come out of the feeding path of the slide fastener chain, so that the threading operation fails. Particularly, where the threading operation is automated, the matter is made much worse, since the threading operation automatically continues, even if the slider comes out of the feeding path of the slide fastener chain. Consequently, in the automatized apparatus, the slider-threading operation oftentimes is interrupted, thus considerably lowering the manufacturing efficiency of slide fasteners.

SUMMARY OF THE INVENTION

With the foregoing difficulties in view, it is therefore an object of the present invention to provide a relatively simple slide holding apparatus which can hold a slider firmly and stably, so that the holder does not unexpectedly wobble during threading of a continuous slide fastener chain through a slider even when the slide fastener chain has a succession of fabric pieces attached to each of the opposed longitudinal marginal edges thereof.

According to the present invention, there is provided an apparatus for holding a slider during threading through the slider a continuous slide fastener chain having a succession of fabric pieces along each of the opposite longitudinal marginal edges. The apparatus comprises a slider holder adapted to releasably hold a slider on its top surface. The holder is movable vertically between a lowermost position where the slider holder receives a slider and an uppermost position where the fabric-pieced slide fastener chain is threaded through the slider. The apparatus includes a slider holder retainer disposed on the path of vertical movement of the slider holder. The slider holder retainer has a U-shaped frame including a frame base and a pair of opposed legs, and a pair of rotary retainers, one rotatably mounted on each of the distal ends of the opposed legs and disposed coplanar with each other. When assuming the uppermost position, the slider holder comes between the legs with the sides of the slider holder abutting the rear surfaces of the rotary retainers.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
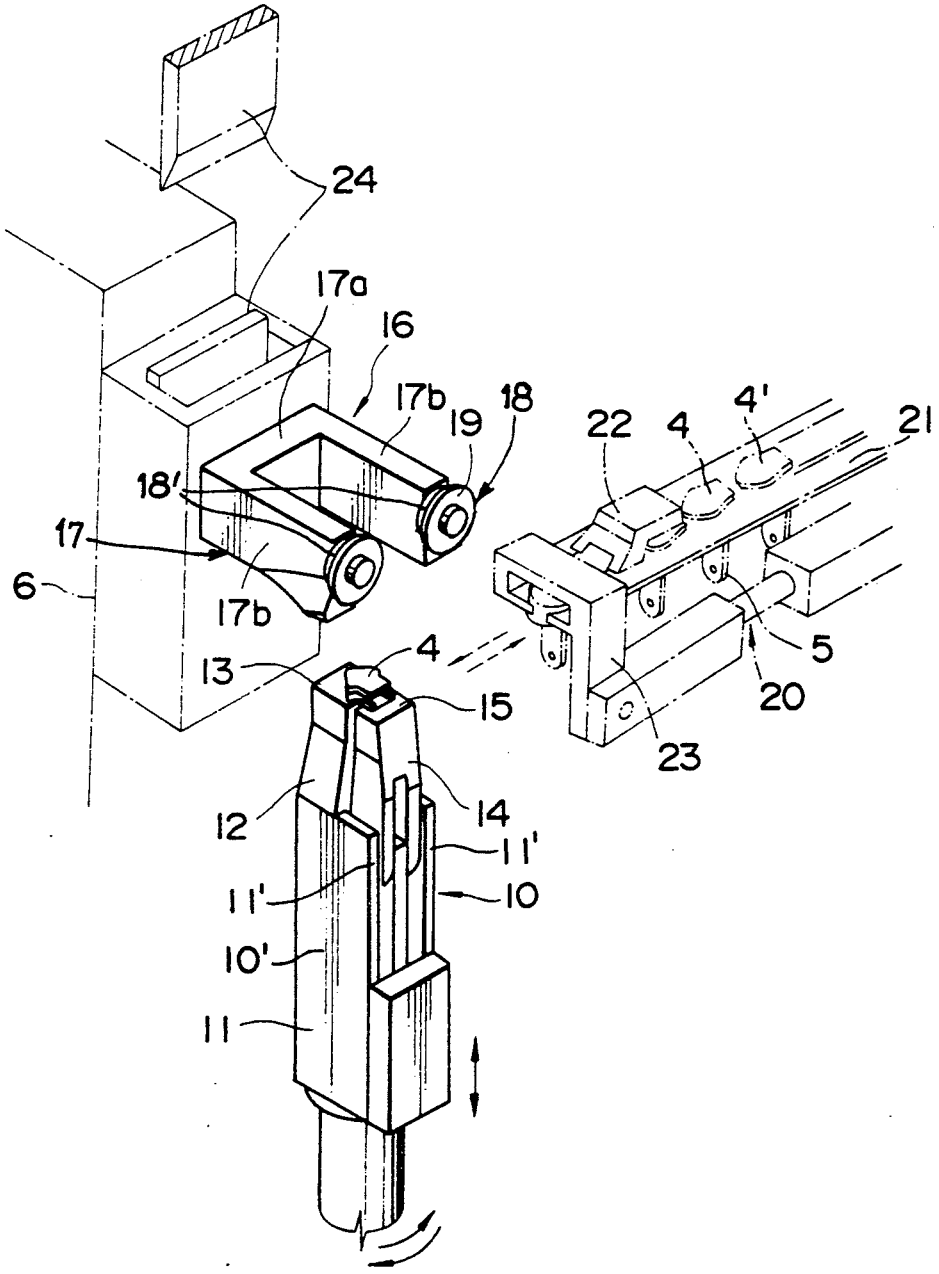
FIG. 1 is a perspective view of a slider holding apparatus according to the present invention and some devices associated therewith and disposed therearound.

FIG. 1 shows a slider holding apparatus embodying the present invention in solid lines and its associated devices disposed therearound in phantom lines. The slider holding apparatus is intended to hold a slider 4 thereon during threading of a continuous slide fastener chain F through the slider 4. The slide fastener chain F has a succession of fabric pieces 3 attached to each of the opposed longitudinal marginal edges thereof (hereinafter referred to as a fabric-pieced slide fastener chain 1 for brevity's sake).

Figure 2:
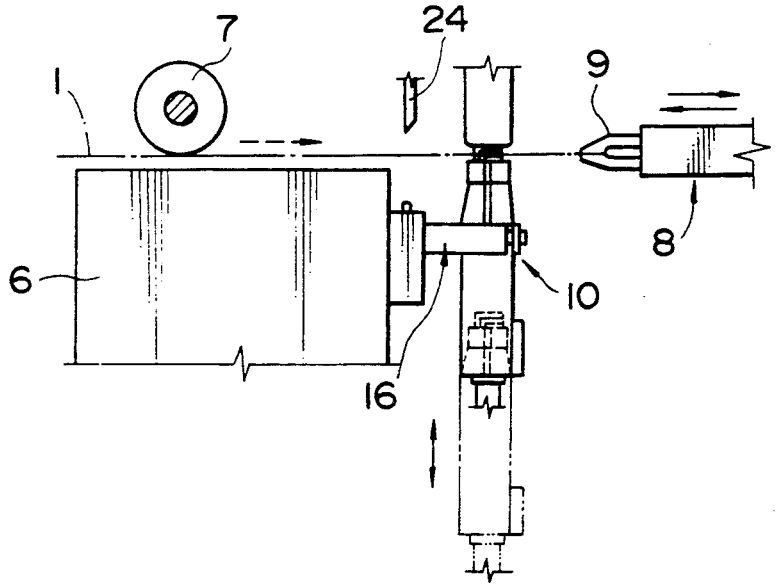
FIG. 2 is a schematic front view of the apparatus and the associated devices of FIG. 1.

Among the associated devices are the following: a feed table 6; a guide roller 7; a cutting unit 24 disposed upstream of the slider holding apparatus; and a chain feeding unit 8 disposed downstream of the slider holding apparatus (as better shown in FIG. 2). In addition, a slider-supplying unit 20 is disposed laterally of the feeding path of the fabric-pieced slide fastener chain 1, as shown in FIG. 1.

The construction of the continuous slide fastener chain F and the slider 4 to be worked upon by the slider holding apparatus is described below, although the construction of these elements is well-known in this field.

Figure 3:
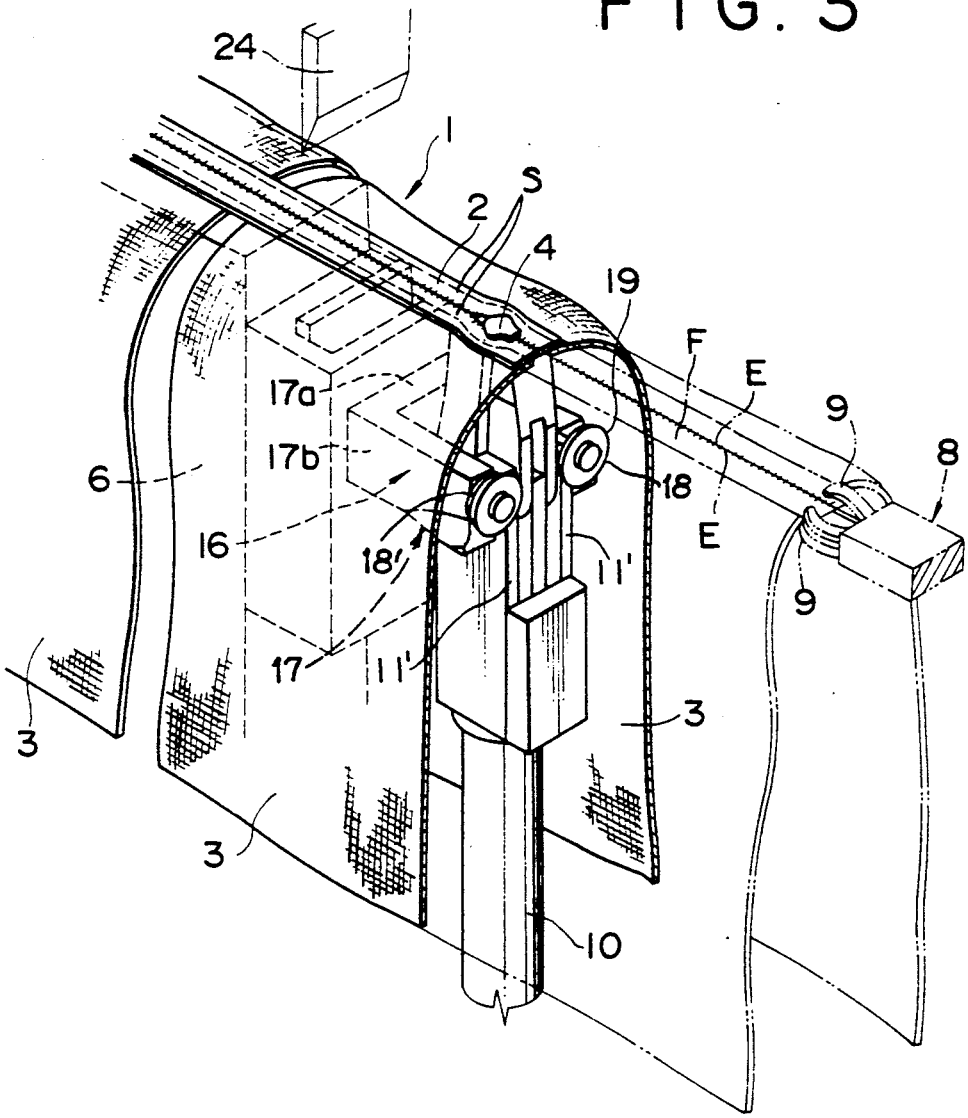
FIG. 3 is a view similar to FIG. 1 in which the slider holding apparatus is shown coming into the uppermost position for threading operation of a fabric-pieced slide fastener chain through a slider.
Figure 4:
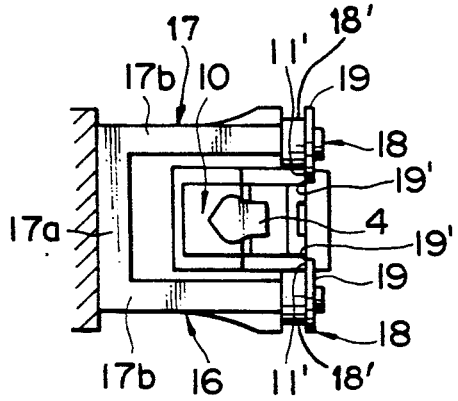
FIG. 4 is a plan view of the slider holding apparatus of FIG. 1.

As shown in FIG. 3, the continuous slide fastener chain F comprises a pair of continuous slide fastener chain halves or continuous slide fastener stringers S, S having two continuous fastener element rows E, E attached to the respective opposed inner longitudinal edges thereof.

As shown in FIG. 1, the slider 4 comprises a slider body 4' and a pull tab 5 pivotally connected to the slider body 4'. The slider body 4' has a Y-shaped channel formed therethrough for receiving the fastener element rows E, E of the continuous slide fastener stringers S, S.

The slider holding apparatus broadly comprises a slider holder 10 intended for holding a slider 4 on its top, and a slider holder retainer 16 intended for retaining the slider holder 10 firm and stable.

The slider holder 10 is in the shape of an upright elongated rectangular parallelepipedon to allow the fabric-pieced slide fastener chain 1 to smoothly pass thereby. The slider holder 10 generally comprises a holder body 10', a supporting arm 12 and a supporting lever 14.

The holder body 10' includes a pair of spaced confronting vertical walls 11, 11 to define a space therebetween in which the supporting arm 12 and the supporting lever 14 are disposed.

The supporting arm 12 is pivotally connected at its lower end to the vertical walls 11, 11 and has at its top surface a first seat half 13 on which a front part of a slider 4 rests. The supporting arm 12 is angularly moved slightly counterclockwise—as viewed in FIG. 1—and restored into an original upright position to hold a pull tab 5 of the slider 4, to thus hold the slider 4 in cooperation with the locking lever 14 as shown in FIG. 1.

The supporting lever 14 is also pivotally connected at its lower end to the opposed vertical walls 11, 11 and has at its top surface a second seat half 15 on which a rear part of the slider 4 is to rest. The supporting lever 14 is angularly moved slightly clockwise to define with the supporting arm 12 a space for receiving a slider 4 to be supplied from the slider supplying apparatus 20. After receiving the slider 4, the supporting lever 14 is angularly moved counterclockwise so that the supporting lever 14 and the supporting arm 12 coact with each other in holding the slider 4 on their respective seat halves 15, 13 with its pull tab 5 clamped therebetween.

The slider holder 10 is vertically movable as indicated in a double-headed arrow in FIGS. 1 and 2—between its lowermost position (where the slider holder 10 receives a slider 4 from a slider supplying unit 20) and its uppermost position (where the fabric-pieced slide fastener chain 1 is threaded through the slider 4 by means of a drive means such as an air cylinder (not shown)). As shown in FIG. 1, the direction in which the slider holder is oriented when receiving a slider 4 from a slider supplying unit 20 is normal to the one in which it is oriented when holding the slider 4 during the threading operation of the fabric-pieced slide fastener chain 1 through the slider 4. In order to compensate for this, the slider holder 10 is rotated about its own axis by 90 degrees alternately clockwise and counterclockwise—as indicated by one-headed arrows in FIG. 1—by a suitable mechanism such as a rack-and-pinion (not shown). If such a slider supplying unit 20 were employed in which the slider 4 were supplied therealong as oriented in the same direction as when receiving the fabric-pieced slide fastener chain 1, then the slide holder 10 need not be rotated on its own axis, of course.

The slider supplying unit 20 is disposed far enough away from the slider holder 10 so as not to block the path of the fabric pieces 3 attached to the opposed marginal sides of the slide fastener chain F. In order to facilitate arrangement of the other associated devices, the slider supplying unit 20 is disposed laterally of the path of the fabric-pieced slide fastener chain 1, as shown in FIG. 1. The slider supplying unit 20 includes a chute 21 for continuously sliding down sliders 4 from a hopper (not shown), a pusher 22 provided adjacent to one end of the chute 21 for pushing sliders 4 forward one after another, and a feeder 23 provided at the end of the chute 21 for feeding the thus pushed sliders 4 to the slider holder 10 between its supporting arm 12 and its supporting lever 14.

Turning now to the slider holder retainer 16, as shown in FIGS. 2 and 3, the slider holder retainer 16 is disposed on the path of the vertical movement of the slider holder 10, and is intended to guide the slider holder 10 as the latter ascends to its uppermost position for threading the fabric-pieced slide fastener chain 1 through the slider 4. In addition, the slider holder retainer 16 is also intended to retain the slider holder 10 against being wobbled by the weight of the fabric-pieces slide fastener chain 1 and against being pulled downstream by the fabric-pieced slide fastener chain 1 it is dragged by a feeding unit 8.

As better shown in FIG. 2, the slider holder retainer 16 is mounted on a downstream side of a cutting unit 24, which is in turn mounted on a downstream side of a feed table 6. The slider holder 10 is made relatively thin by comparison with the feeding table 6 and the cutting unit 24, so that their respective opposite sides are prevented from touching the fabric pieces 3 hanging down from the opposite sides of the slide fastener chain F. As better shown in FIG. 1, the slider holder retainer 16 includes a U-shaped frame 17 and a pair of flanged rotors 18, 18. The U-shaped frame 17 includes a frame base **17*a* mounted on the downstream side of the cutting unit 24 and a pair of opposed legs 17*b*, 17*b* extending from the opposite ends of the frame base 17*a* laterally of the path of vertical movement of the slider holder 10. The pair of flanged rotors 18, 18 are rotatably mounted, one on each of the distal ends of the opposed legs 17*b*, 17*b*. Each of the flanged rotors 18, 18 has a rotor 18' and a flange 19 projecting around the rim of the rotor 18', the respective flanges 19, 19 of the flanged rotor 18, 18** being coplanar with each other.

With arrangement of the slider holder retainer 16, the opposed legs **17*b*, 17*b* let the slider holder 10 pass therebetween as the slider holder 10 ascends and, when the slider holder 10 assumes the uppermost position, support the slider holder 10 therebetween against wobbling laterally of the path of the fabric-pieced slide fastener chain 1. Furthermore, each of the flanged rotors 18, 18 has the rear surface 19' of the flange 19 abutting the "relevant" side—specifically the side edges 11' of the opposed vertical walls 11, 11—of the slider holder 10, to thus smoothly guide the slider holder 10 moving vertically between the opposed legs 17*b*, 17*b*. When the slider holder 10 assumes the uppermost position, abutment between the rear surface 19' and the side edge 11' prevents the slider holder 10 from being unexpectedly pulled downstream by the fabric-pieced slide fastener chain 1 that is dragged downstream by the feeding unit 8**.

Turning now to the operation of the apparatus according to the present invention, first of all, the slider holder 10 descends to the lowermost position, whereat the supporting lever 14 angularly moves into an inclined position to thus provide an ample space for receiving a slider 4. At the same time, the slider holder 10 rotates on its own axis counterclockwise at 90 degrees. Then, the slider feeder 23 advances toward the slider holder 10 at its lowermost position to feed the slider 4 to the first slider seat half 13 of the supporting arm 12, and then retracts to the original position. Thereafter, the supporting lever 14 angularly moves back to an upright position so that the slider 4 rests on the first seat half 13 of the supporting arm 13 and the second eat half 15 of the supporting lever 14. Then, the slider holder 10 rotates on its own axis clockwise at 90 degrees at the chain 1. Furthermore, each of the flanged rotors 18, 18 has the rear surface 19' of the flanges 19, 19 abutting the side edges 11' of the opposed vertical walls 11, 11 of the slider holder 10, to thus smoothly guide vertical movement of the slider holder 10. When the slider holder 10 assumes the uppermost position, this abutment prevents the slider holder 10 from being pulled titled by the fabric-pieced slide fastener chain 1 when being dragged downstream by the feeding unit 8. As a result, the fabric-pieced slide fastener chain 1 can be threaded through the slider 4 reliably and stably, which advantageously facilitates automated and higher-speed manufacture of slide fasteners as a whole.

Instead of the flanged rotors 18, 18 in the preceding embodiment, a pair of disks may be rotatably mounted on the distal ends of the opposed legs **17*b*, 17*b* in which event, the rear surfaces of the disks abut the relevant sides of the slider holder 10**.

Obviously, various modifications and variations of the present invention are possible in the light of the above teaching. It is therefore to be understood that within the scope of the appended claims the invention may be practiced otherwise than as specifically described.

What is claimed is:

1. An apparatus for holding a slider during threading through the slider a continuous slide fastener chain having a succession of fabric pieces along each of the opposite longitudinal marginal edges, the apparatus comprising:

(a) a slider holder for releasably holding a slider on its top surface, said slide holder being movable vertically between a lowermost position where the slider holder receives a slider and an uppermost position where the fabric-pieced slide fastener chain is threaded through the slider; and (b) a slider holder retainer disposed on the path of vertical movement of the slider holder and comprising a U-shaped frame including a frame base and a pair of opposed legs, and a pair of rotary retainers having rear surfaces, said rotary retainers being respectively rotatably mounted on each of the distal ends of the opposed legs and disposed coplanar with each other; whereby, assuming the uppermost position, the slider holder comes between the legs, and a pair of side edges of the slider holder abut the rear surfaces of the rotary retainers.

2. An apparatus according to claim 1, each rotary retainer being a flanged rotor including a rotor and a flange projecting around the rim thereof, wherein said rear surfaces of the rotary retainers comprise rear surfaces of the flanges.

3. An apparatus according to claim 1, each rotary retainer being a rotary disk rotatably mounted on a axle secured to the distal end of the leg, wherein said rear surfaces of said rotary retainers comprise rear surfaces of the rotary disks.

* * * * *